US007500485B1

(12) United States Patent
Shepard et al.

(10) Patent No.: US 7,500,485 B1
(45) Date of Patent: Mar. 10, 2009

(54) FOAMED TOBACCO PRODUCTS AND METHOD OF MAKING SAME

(75) Inventors: Charles B. Shepard, South Windsor, CT (US); Raymond A. Voorhies, Windsor, CT (US)

(73) Assignee: NuWay Tobacco Company, South Windsor, CT (US)

( * ) Notice: Subject to any disclaimer, the term of this patent is extended or adjusted under 35 U.S.C. 154(b) by 751 days.

(21) Appl. No.: 11/088,407

(22) Filed: Mar. 24, 2005

Related U.S. Application Data

(63) Continuation of application No. 10/802,209, filed on Mar. 17, 2004, now abandoned.

(51) Int. Cl.
*A24B 15/00* (2006.01)

(52) U.S. Cl. ..... 131/309; 131/310

(58) Field of Classification Search ..... 131/309–310, 131/345, 353, 355
See application file for complete search history.

(56) References Cited

U.S. PATENT DOCUMENTS

| | | | | | |
|---|---|---|---|---|---|
| 3,404,690 | A | * | 10/1968 | Moshy et al. | 131/355 |
| 3,528,434 | A | * | 9/1970 | Fiore et al. | 131/370 |
| 3,613,693 | A | | 10/1971 | Monte | 131/140 |
| 3,872,871 | A | | 3/1975 | Fiore et al. | 131/140 P |
| 4,002,178 | A | | 1/1977 | Fiore et al. | 131/15 R |
| 4,228,277 | A | | 10/1980 | Landoll | 536/90 |
| 4,683,004 | A | | 7/1987 | Goddard | 106/170 |
| 5,140,099 | A | | 8/1992 | Bostrom et al. | 536/91 |
| 5,303,720 | A | | 4/1994 | Banerjee et al. | 131/194 |

OTHER PUBLICATIONS

Gelman, R.A.; "Hydrophobically Modified Hydroxyethylcellulose"; TAPPI Proceedings; 1987 International Dissolving Pulps Conference; pp. 159-165.
Hercules Technical Information; 23.100-E4; Natrosol® *Plus*, grade 331, hydrophobically modified hydroxyethylcellulose; © Hercules Incorporated, 2000.
Hercules; Aqualon Products: An Overview, no date.
Akzo Nobel Surface Chemistry, no date.
Bermocoll in Latex Paint, no date.
Natrosol® *Plus*; Modified Hydroxyethylcellulose; Hercules Incorporated, Feb. 2004.

* cited by examiner

*Primary Examiner*—Carlos Lopez
(74) *Attorney, Agent, or Firm*—Alix, Yale & Ristas, LLP

(57) ABSTRACT

Disclosed herein is a foamed tobacco composition which includes tobacco particles, water and a foam stabilizer which is a hydrophobically modified hydroxyalkylated carbohydrate. In another form of the invention, the foam stabilizer is a hydrophobically modified cellulose ether. The foam stabilizer enables foaming to take place at significantly higher temperatures than are required when conventional foam stabilizers are used, thereby improving the efficiency of the foaming process. A tobacco product and a method of making a tobacco product also are disclosed.

21 Claims, No Drawings

FOAMED TOBACCO PRODUCTS AND METHOD OF MAKING SAME

RELATED APPLICATIONS

This is a continuation of prior U.S. patent application Ser. No. 10/802,209 filed Mar. 17, 2004, now abandoned.

BACKGROUND OF THE INVENTION

The present invention relates generally to foamed tobacco products, and more particularly to an efficient method of producing foamed tobacco products with uniform characteristics.

It is known from U.S. Pat. No. 3,872,871 to make low density cigar tobacco sheet material from a foamed intermediate having a particular bubble size distribution, resulting in a product that is said to have excellent taste. In order to obtain a high quality foam, a stabilizer is added to the slurry prior to high speed agitation. Known stabilizers, such as ethylhydroxyethylcelluloses, are mixed ethers of cellulose prepared by the reaction of alkali cellulose with ethylene oxide, to make hydroxyethoxyl groups, and with ethyl chloride, to make ethoxyl groups. The hydroxyethoxyl groups render the resulting polymer more hydrophilic, while the ethoxyl groups render it more hydrophobic. U.S. Pat. No. 3,872,871 describes an ethylhydroxyethylcellulose (EHEC) derivative which is relatively more highly substituted with ethoxyl groups, as is evidenced by its having a cloud point (the temperature at which the polymer starts to come out of solution, when heated) of only 30-40° C. (86-104° F.).

U.S. Pat. No. 3,613,693 describes a method for producing reconstituted tobacco products using a particular type of ethylhydroxyethylcellulose. The method requires the use of cool temperatures for foaming. More particularly, U.S. Pat. No. 3,613,693 states that the temperature should be 25° C. (77° F.) or less in order for the EHEC to dissolve in water. The patent further indicates that if the temperature of insolubility is reached during mixing of the slurry, foaming, transfer or shaping of the foam, precipitation of the EHEC will occur and the foam stabilization property of the EHEC will be lost. While the method described in this patent produces a useful product, it requires the use of a cooling stage prior to and/or during agitation in order to ensure that the EHEC stays soluble in the aqueous solution. The use of a cooling stage adds to the overall cost of the process.

SUMMARY OF THE INVENTION

An object of the present invention is to provide a novel process for producing a low density tobacco sheet material and other foamed tobacco products.

Another object of the invention is to provide a foamed tobacco composition with excellent foam stability, and which yields a high quality foamed tobacco product upon drying.

Another object of the invention is to provide a process for producing tobacco products having excellent uniformity in which the requirement for cooling the tobacco slurry prior to and/or during agitation is eliminated or minimized.

A further object of the invention is to provide a more efficient method of making reconstituted tobacco products.

Other objects of the invention will become apparent from the following description of the invention.

The invention in a preferred form is a foamed tobacco composition comprising tobacco particles, water and a foam stabilizer comprising a hydroxyalkylated carbohydrate, the carbohydrate including a long chain alkyl or aralkyl group having 10-36 carbon atoms in an amount up to that which renders said carbohydrate less than 1 wt % soluble in water. The composition has an average bubble diameter in the range of 40-75 microns with at least 98% of the bubbles having a diameter of 150 microns or less. Preferably, the long chain alkyl or aralkyl group is attached to the carbohydrate by an ether linkage. The hydroxyalkylated carbohydrate typically is a cellulose ether. More preferably, it is hydroxyethylcellulose or ethylhydroxyethylcellulose. Preferably, the composition also includes a foaming agent.

Another preferred form of the invention is a foamed tobacco composition comprising tobacco particles, water, and a foam stabilizer comprising a cellulose ether having a sufficient degree of substitution of at least one member selected from the group consisting of methyl, ethyl, hydroxyethyl and hydroxypropyl groups to render the cellulose ether water soluble. The cellulose ether is further substituted with a long chain alkyl or aralkyl group having 10-36 carbon atoms in an amount between 0.1 wt % and the amount which renders the cellulose ether less than 1 wt % soluble in water. The cellulose ether preferably is present in an amount of 0.1-20 wt % on a dry basis. The long chain alkyl or aralkyl group preferably is attached to the cellulose ether by an ether linkage. Preferably, the cellulose ether is an alkyl or aralkyl-modified hydroxyethylcellulose or ethylhydroxyethylcellulose.

A further preferred form of the invention is a foamed tobacco composition comprising tobacco particles, water and a foam stabilizer comprising a hydrophobically modified hydroxyalkylated carbohydrate, said foamed tobacco composition having an average bubble diameter in the range of 40-75 microns with at least 98% of the bubbles having a diameter of 150 microns or less. The hydroxyalkylated carbohydrate preferably is non-ionic.

Yet another form of the invention is a tobacco product containing tobacco particles, water, and a dried foam stabilizer comprising a non-ionic hydroxyalkylated carbohydrate, said carbohydrate including a long chain alkyl or aralkyl group having 10-36 carbon atoms in an amount up to that which renders said carbohydrate less than 1 wt % soluble if placed in water, said product having a substantially closed cell structure.

Another preferred form of the invention is a tobacco product comprising tobacco particles and a dried foam stabilizer comprising a cellulose ether having a sufficient degree of substitution of at least one member selected from the group consisting of methyl, ethyl, hydroxyethyl and hydroxypropyl groups to render the cellulose ether water soluble. The cellulose ether is further substituted with a long chain alkyl or aralkyl group having 10-36 carbon atoms in an amount between 0.1 wt. % and the amount which renders the cellulose ether less than 1% soluble in water. The product has a substantially closed cell structure.

Yet another form of the invention is a method of making a tobacco product comprising the steps of forming an aqueous slurry comprising tobacco particles and a foam stabilizer comprising a hydroxyalkylated carbohydrate, agitating the slurry under conditions of high shear in order to form a foam, shaping the foam and drying the shaped foam. The foam stabilizer includes a long chain alkyl or aralkyl group having 10-36 carbon atoms in an amount up to that which renders said carbohydrate less than 1 wt. % soluble in water. In one embodiment, the foam stabilizer comprises a cellulose ether with a sufficient degree of substitution of at least one member selected from the group consisting of methyl, ethyl, hydroxyethyl and hydroxypropyl groups to render the cellulose ether water soluble. The foam preferably has a temperature at least 90° F. after agitation.

Another form of the invention is a method of making a tobacco product having a substantially closed cell structure comprising the steps of forming an aqueous slurry containing tobacco particles and a foam stabilizer comprising a hydrophobically modified hydroxyalkylated carbohydrate, agitating the slurry under conditions of high shear in order to form a stabilized foam, the temperature of the slurry increasing to at least 90° F. during foaming, shaping the foam, and drying the shaped foam. Preferably, the slurry is not cooled during the agitation step.

DETAILED DESCRIPTION OF THE INVENTION

The inventors have surprisingly found that by using a special class of carbohydrate polymers as a foam stabilizer, a reconstituted tobacco foam intermediate having excellent stabilization and a desired fine bubble size distribution can be obtained. By using a different type of foam stabilizer than has been used in the past, it has been discovered that the foaming and shaping processes can take place at a significantly higher temperature than the temperature employed when conventional foam stabilizers are used. This process improvement results in substantial cost savings both in terms of the investment required for equipment and the operating costs. The use of a higher temperature foaming process is unexpected in view of prior teachings in the field of tobacco processing.

According to the invention, an aqueous tobacco slurry is formed using a hydrophobically modified hydroxyalkylated carbohydrate as the foam stabilizer. This group of polymers, which includes, but is not limited to, cellulosic associative thickeners, allows one to circumvent the limitations imposed by low gelation temperature hydroxyalkylated carbohydrates. The polymers used in the invention are characterized by a small number of hydrophobes attached to the modified carbohydrate backbone. Viscosity in these materials is built not only by chain entanglement of the individual polymer molecules, but also by association of the hydrophobic groups on different chains.

One group of polymers which is particularly preferred for use in accordance with the invention is a hydrophobically modified cellulose ether. This type of cellulose ether has a sufficient degree of substitution of at least one member selected from the group consisting of methyl, ethyl, hydroxyethyl and hydroxypropyl groups to render it water soluble under ambient conditions. The cellulose ether is further substituted with a long chain alkyl or aralkyl radical having 10-36 carbon atoms in an amount between about 0.1 wt. percent and the amount which renders the cellulose ether less than 1 wt. % soluble in water. The alkyl or aralkyl radical typically is attached to the cellulose ether by an ether linkage. The hydrophobically modified cellulose ether preferably is non-ionic.

In a preferred form of the invention, the cellulose ether is hydroxyethylcellulose or ethylhydroxyethylcellulose. This material preferably is further substituted with an alkyl or aralkyl radical derived from an alkyl or aralkyl glycidyl ether. The alkyl or aralkyl group may be attached to the cellulose ether by means of an ether, ester or urethane linkage or by another group that will covalently bind the hydrophobic moiety to the cellulose ether.

Another group of polymers which is useful according to the invention is a derivative of a galactomannan having hydroxyethyl or hydroxypropyl substitution and which is further substituted with an alkyl or aralkyl group containing 10-36 carbon atoms. The substitution of hydroxyethyl or hydroxypropyl preferably is in an amount between 0.1 and about 2 moles per anhydropyranose unit of the galatomannan. Suitable galactomannans include guar, with the long chain alkyl or aralkyl group attached as an ether, such as a substituted glycidyl ether.

When the foam stabilizer also functions as a foaming agent and an adhesive, it preferably is used in amounts of 4-20 wt. % on a dry basis. Particularly good results are achieved when the material is used in an amount of 5-15 wt. % on a dry basis. Most preferably 10-12 weight % on a dry basis is used. When other materials are added as a foaming agent and an adhesive, the foam stabilizer is used in an amount of about 0.1-2.5 weight % on a dry basis, more preferably 0.1-1 wt %, and most preferably 0.2-0.4 wt % on a dry basis.

In contrast to conventional ethylhydroxyethylcellulose, the hydrophobically modified hydroxylated carbohydrates such as hydrophobically modified hydroxyethylcellulose and ethylhydroxyethylcellulose have cloud points at or above 160° F. (71° C.). Some hydrophobically modified cellulosic polymers, particularly those based upon the more hydrophilic cellulose derivatives such as hydroxyethylcellulose have a cloud point above the boiling point of water, 212° F. (100° C.). As a result, the foamed intermediate will remain stable at temperatures of 90-160° F. (32-71° C.), and potentially even as high as the cloud point of the stabilizer. Use of a higher temperature process results in reduced heating requirements for drying the shaped product, as well as reduced refrigeration requirements prior to agitation. Higher temperature agitation of the foam can lead to even higher shear rates in the foaming process, resulting in a foam with small bubbles and a dried product with a closed cell structure.

According to the invention, a foamable composition is formed containing water, tobacco and a small quantity of a foam stabilizer, typically 0.1 to 2.5 wt % foam stabilizer on a dry basis, preferably 0.1 to 1 wt % and more preferably 0.2 to 0.4 wt %. The slurry typically contains about 5-10 weight % solids. Optionally, additives are included such as wood fiber or another sheet strengthener in an amount of 5-15 wt % on a dry basis, and an ash additive such as diatomaceous earth in an amount of 5-10 wt % on a dry basis or titanium dioxide in an amount of 1-5 wt % on a dry basis. A foaming agent typically is included in an amount of 2-12 wt % on a dry basis, more preferably 3-10 wt % and most preferably 5-7 wt %. An adhesive in an amount of 1-11 wt % on a dry basis, more preferably 2-8 wt % and most preferably 4-6 wt % is usually added. Furthermore, additives such as humectants, wet strength agents, plasticizers, fungicides, cross-linking agents, insolubilizing agents, colorants and/or fillers can be included.

It is noted that additional quantities of foam stabilizer can be added to function as a foaming agent and/or adhesive, but due to the cost of the foam stabilizer, other materials are preferred for use as the foaming agent and adhesive. Adhesive is not required if the tobacco has adhesive properties. A gas such as nitrogen may be used for foaming.

Suitable foaming agents are conventional adhesives such as those disclosed in U.S. Pat. No. 3,613,693, and include, but are not limited to, animal gums, such as glycogen, plant gums, and derivatives, such as cellulose ethers, cellulose esters, starches, starch ethers, starch esters, amylose, amylopectin, and their ester and ether derivatives, locust bean gum, guar gum, gum arabic and related seed gums and plant exudate gums, marine plant gums, microbial gums, and water-dispersible proteins such as animal and vegetable proteins.

Foamed reconstituted tobacco products according to the invention can be shaped into sheets, rods, cylinders, plugs, shreds, and other shapes used in making smoking articles of various shapes. Sheets preferably are made in a thickness suitable to their end use and are cut to size. Thin sheets can be formed and then shredded for use as a filler in cigars, cigarettes or pipes.

The non-ionic hydrophobically modified cellulose ethers used as foam stabilizers in this invention have been used in the past as thickeners for shampoo, paint, paper coatings, toothpastes, and a wide range of end uses. Certain types of these polymers are described in U.S. Pat. No. 4,228,277. The low molecular weight cellulose ethers described in the '277 patent are said to be particularly well-suited for use as stabilizers in emulsion polymerization, thickeners in cosmetics and water-based paint, and flocculants in mineral processing.

According to the method of the invention, an aqueous dispersion of tobacco, foam stabilizer and optional additives is prepared. The dispersion usually is prepared at room temperature using water having a temperature of 50-80° F. (10-26.7° F.) and is pumped through a high speed rotor/stator mixer. A gas, typically nitrogen, is injected into the slurry at the mixer inlet. If no cooling is used during agitation, the high shear forces in the mixer result in a temperature increase of the mixture of about 20-40° F. or higher, during foaming. The resulting foam, which may remain stable for several hours, but is typically processed within several minutes, has a bubble size distribution in which the average bubble size is 40-75 microns, or more preferably 40-65 microns, with more than 50% of the bubbles having a diameter of 50 microns or less, at least 90% of the bubbles having a diameter of 100 microns or less, and at least 98% of the bubbles having a diameter of 150 microns or less when the temperature of the foam is up to 125° F. (51.7° C.). The bubble size distribution is usually measured when the temperature of the foam is 60-120° F. (15.6-48.9° C.). This type of bubble size distribution results in a dried product having a closed cell structure. The foaming process can be carried out at temperatures of 90-125° F. (32.2-51.7° C.) and even as high as 160° F. (71.1° C.) without experiencing any thermal degradation of the foam. This is in contrast to prior known processes using conventional ethylhydroxyethylcellulose, which has very limited water solubility at temperatures greater than about 77° F. (25° C.). In processes using conventional ethylhydroxyethylcellulose, foaming temperatures above about 87° F. (30.6° C.) generally result in thermal degradation of the foam, which would produce a dried product with a non-uniform, at least partially open cell structure.

During the period in which the foam remains substantially stable, it is shaped using conventional equipment, and then dried. When thin sheets are made, the foam typically is cast onto a moving conveyor belt, where it is dried in the form of a continuous sheet.

As an alternative to eliminating the cooling step prior to agitation, the cooling capacity of the process can be maintained at a conventional level while running the machines at a speed about 10% higher than the current speed, thus, increasing the rate of production by 10%.

The following Examples are given by way of illustration and are not intended to limit the scope of the invention.

EXAMPLE 1

An aqueous base web makeup and an aqueous tobacco water makeup were combined in a ratio of 37 wt % (based on solids) base web makeup and 63 wt % (based on solids) tobacco water makeup. The solids content of the base web makeup and the tobacco water makeup were 4 wt % and 15 wt %, respectively.

The base web makeup included, on a dry basis, 27.7 wt % wood fiber, 19.3 wt % diatomaceous earth, 18.9% foaming agent/adhesive, which was a methylhydroxyethylcellulose that was not hydrophobically modified, 14.3 wt % adhesive, which was a galactomannan that was not hydrophobically modified, 13.0 wt % humectant and plasticizer, 4.6 wt % crosslinking agent, 1.3 wt % pH adjuster, and 0.8 wt % foam stabilizer. The foam stabilizer was a hydrophobically modified ethylhydroxyethylcellulose (Bermocoll EHM200, Akzo Nobel, Stenungsund, Sweden).

The tobacco water makeup included, on a dry basis, 98.7 wt % tobacco, the remainder being colorants, preservatives and pH adjusters. The slurry had a temperature of about 75° F. (23.9° C.) after the two parts were combined. The mixture was then cooled to 60-65° F. (15.5-18° C.). After cooling, the slurry was subjected to high speed mixing and the injection of nitrogen gas in order to form a foamed slurry. The vessel containing the slurry was cooled during agitation in order that the temperature of the slurry did not rise above about 85° F. (29.4° C.) during the mixing.

A representative sample of the foamed intermediate having a temperature of about 85° F. (29.4° C.) was removed and examined under a microscope to determine the bubble size distribution. The bubbles had an average diameter of 50 microns. It was found that 56.6% of the bubbles had a diameter less then 50 microns and 100% of the bubbles had a diameter of less than 100 microns. The rest of the slurry was shaped into sheets and was dried to form sheets having a thickness of about 0.0025 inches.

CONTROL EXAMPLE 1

The procedure of Example 1 was repeated with the exception that a conventional ethylhydroxyethylcellulose foam stabilizer was used, Bermocoll CST 625 (Akzo Nobel, Stenungsund, Sweden). A representative sample of the foamed intermediate having a temperature of about 85° F. (29.4° C.) was examined under a microscope to determine the bubble size distribution. The bubbles had an average diameter of 48 microns. It was found that 60.1% of the bubbles had a diameter of less than 50 microns, 99.5% of the bubbles had a diameter of less than 100 microns, and none of the bubbles had a diameter of more than 150 microns.

EXAMPLE 2

The procedure of Example 1 was repeated with the exception that a hydrophobically modified hydroxyethylcellulose was used, namely Natrosol Plus (Hercules Inc., Wilmington, Del.). A representative sample of the stabilized foamed intermediate having a temperature of about 85° F. (29.4° C.) was examined under a microscope to determine the bubble size distribution. The bubbles had an average diameter of 51 microns. It was found that 52.9% of the bubbles had a diameter of less than 50 microns, 97.5% of the bubbles had a diameter of less than 100 microns, and 0.6% of the bubbles had a diameter of more than 150 microns.

CONTROL EXAMPLE 2

The procedure of Control Example 1 was repeated. A representative sample of the stabilized foamed intermediate having a temperature of about 85° F. (29.4° C.) was examined under a microscope and was found to have an average bubble diameter of 55 microns. Furthermore, 38.3% of the bubbles had a diameter less than 50 microns, 98.3% of the bubbles had a diameter of less than 100 microns, and 0.8% of the bubbles had a diameter of more than 150 microns.

EXAMPLE 3

The procedure of Example 2 was repeated with the exception that the slurry was not cooled after the two parts of the mixture were combined, and was not cooled during agitation. It is believed that the temperature of the slurry prior to agitation was in the range of 90-100° F. (32.2-37.8° C.), although a measurement was not taken. The temperature of the slurry rose to 118° F. (47.8° C.) during agitation. Due to the use of a hydrophobically modified foam stabilizer, this high temperature did not cause thermal degradation of the foam.

A representative sample of the stabilized, foamed intermediate having a temperature of about 118° F. (47.8° C.) was examined under a microscope to determine the bubble size distribution. The bubbles had an average diameter of 46 microns. It was found that 61% of the bubbles had a diameter of less than 50 microns, and that 100% of the bubbles had a diameter of less than 100 microns. The rest of the slurry was shaped into thin sheets and was dried.

EXAMPLE 4

Separate aqueous solutions of the hydrophobically modified ethylhydroxyethylcellulose of Example 1, the hydrophobically modified hydroxyethylcellulose of Example 2 and the unmodified ethylhydroxyethyl cellulose of Control Examples 1 and 2 were prepared, each having a cellulose ether concentration of 1.0 wt. %. These solutions were slowly heated and the transparency of the solutions was observed. A lessening of transparency is an indication of the cloud point of the polymer. Normally, this transparency decreases until the polymer is no longer in solution. The unmodified ethylhydroxyethylcellulose (Bermocoll CST 625) had a cloud point of 114° F. No cloud point was detected for the hydrophobically modified hydroxyethylcellulose (Natrosol Plus) at temperatures up to 150° F., at which point the test was ended. The hydrophobically modified ethylhydroxyethylcellulose (Bermocoll EHM 200) had some turbidity at 160° F., at which point the test was ended, but this did not appear to be its cloud point. Thus, it can be concluded that the hydrophobically modified ethylhydroxyethylcellulose and the hydrophobically modified hydroxyethylcellulose have cloud points above 160° F. and 150° F., respectively, and that these materials can be used as foam stabilizers at temperatures up to at least 160° F. for the hydrophobically modified ethylhydroxyethylcellulose and at least 150° F. for the hydrophobically modified hydroxyethylcellulose.

What is claimed is:

1. A foamed tobacco composition comprising:

(a) tobacco particles, (b) water and (c) a foam stabilizer comprising a hydroxyalkylated carbohydrate, said carbohydrate including a long chain alkyl or aralkyl group having 10-36 carbon atoms in an amount up to that which renders said carbohydrate less than 1 wt % soluble in water.

2. A foamed tobacco composition according to claim 1, wherein said composition has an average bubble diameter in the range of 40-75 microns with at least 98% of the bubbles having a diameter of 150 microns or less.

3. A foamed tobacco composition according to claim 1, wherein said long chain alkyl or aralkyl group is attached to said carbohydrate by an ether linkage.

4. A tobacco composition according to claim 1, wherein said hydroxyalkylated carbohydrate is a cellulose ether.

5. A tobacco composition according to claim 4, wherein said hydroxyalkylated carbohydrate is present in an amount of 0.1-0.5 wt % on a dry basis.

6. A foamed tobacco composition comprising:

(a) tobacco particles, (b) water and (c) a foam stabilizer comprising a cellulose ether having a sufficient degree of substitution of at least one member selected from the group consisting of methyl, ethyl, hydroxyethyl and hydroxypropyl groups to render said cellulose ether water soluble, said cellulose ether being further substituted with a long chain alkyl or aralkyl group having 10-36 carbon atoms in an amount between 0.1 wt. % and the amount which renders said cellulose ether less than 1 wt. % soluble in water.

7. A foamed tobacco composition according to claim 6, wherein said composition has an average bubble diameter in the range of 40-75 microns and at least 98% of the bubbles have a diameter of 150 microns or less.

8. A tobacco product containing:

(a) tobacco particles, (b) water and (c) a dried foam stabilizer comprising a hydroxyalkylated carbohydrate, said carbohydrate including a long chain alkyl or aralkyl group having 10-36 carbon atoms in an amount up to that which renders said carbohydrate less than 1 wt % soluble if placed in water, said product having a substantially closed cell structure.

9. A tobacco product according to claim 8, wherein said hydroxyalkylated carbohydrate includes at least one member selected from the group consisting of a hydroxyethylcellulose, ethylhydroxyethylcellulose and a galactomannan.

10. A tobacco product comprising:

(a) tobacco particles and (b) a dried foam stabilizer comprising a cellulose ether having a sufficient degree of substitution of at least one member selected from the group consisting of methyl, ethyl, hydroxyethyl and hydroxypropyl groups to render said cellulose ether soluble if placed in water, said celloluse ether being further substituted with a long chain alkyl or aralkyl group having 10-36 carbon atoms in an amount between 0.1 wt. % and the amount which renders said cellulose ether less than 1 wt. % soluble if placed in water, said product having a substantially closed cell structure.

11. A tobacco product according to claim 10, wherein said long chain alkyl or aralkyl group is attached to said cellulose ether by an ether linkage.

12. A method making a tobacco product comprising the steps of:

(a) forming an aqueous slurry comprising tobacco particles and a foam stabilizer comprising a hydroxyalkylated carbohydrate, said carbohydrate including a long chain alkyl or aralkyl group having 10-36 carbon atoms in an amount up to that which renders said carbohydrate less than 1 wt % soluble in water, (b) agitating the slurry under conditions of high shear in order to form a foam, (c) shaping the foam and (d) drying the shaped foam.

13. A method according to claim 12, wherein said long chain alkyl or aralkyl group is attached to said carbohydrate by an ether linkage.

14. A method according to claim 12, wherein said foam has a temperature of at least 90° F. during agitation.

15. A method according to claim 12, wherein said hydroxyalkylated carbohydrate includes at least one member selected from the group consisting of hydroxyethylcellulose, ethylhydroxyethylcellulose and a galactomannan.

16. A method of making a tobacco product having a substantially closed cell structure comprising the steps of:

(a) forming an aqueous slurry comprising tobacco particles and a foam stabilizer comprising a hydrophobically modified hydroxyalkylated carbohydrate, (b) agitating the slurry under conditions of high shear in order to form a stabilized foam, the temperature of the slurry increasing to at least 90° F. during foaming, (c) shaping the foam and (d) drying the shaped foam.

17. A method according to claim 16, wherein, after agitation, said stabilized foam has an average bubble diameter in the range of 40-75 microns and at least 98% of the bubbles have a diameter of 150 microns or less.

18. A method according to claim 16, wherein the slurry is not cooled during agitation.

19. A method of making a tobacco product comprising the steps of:

(a) forming an aqueous slurry comprising tobacco particles and a foam stabilizer comprising a cellulose ether having a sufficient degree of non-ionic substitution of at least one member selected from the group consisting of methyl, ethyl, hydroxyethyl and hydroxypropyl groups to render said cellulose ether water soluble, said cellulose ether being further substituted with a long chain alkyl or aralkyl group having 10-36 carbon atoms in an amount between 0.1 wt. % and the amount which renders said cellulose ether less than 1 wt. % soluble in water, (b) agitating the slurry under conditions of high shear in order to form a foam, (c) shaping the foam and (d) drying the shaped foam.

20. A method according to claim 19, wherein said foam has a temperature of at least 90° F. during agitation.

21. A method according to claim 20, wherein said cellulose ether is at least one member selected from the group consisting of hydroxyethylcellulose and ethylhydroxyethylcellulose.

* * * * *